US005218846A

United States Patent [19]

Cook et al.

[11] Patent Number: 5,218,846

[45] Date of Patent: Jun. 15, 1993

[54] SHIELD FOR A LOCK OR LOCK BOX

[76] Inventors: Teel M. Cook, 726 Windsor Pkwy., Atlanta, Ga. 30342; Anne L. Montague; Harold A. Montague, both of 1875 Old Alabama Rd., Roswell, Ga. 30076

[21] Appl. No.: 820,532

[22] Filed: Jan. 14, 1992

[51] Int. Cl.[5] ..... E05B 67/38

[52] U.S. Cl. ..... 70/56; 70/54

[58] Field of Search ..... 70/54–56, 70/455aDIG. 56; 292/DIG. 2; 40/310, 331; 206/523–524, 806, 486

[56] References Cited

U.S. PATENT DOCUMENTS

| | | | |
|---|---|---|---|
| 104,441 | 6/1870 | Gale | 70/DIG. 56 |
| D. 307,769 | 5/1990 | Murphy | D20/43 |
| 899,268 | 9/1908 | Soley | 70/53 |
| 1,477,123 | 12/1923 | Hopkins | 40/310 |
| 1,581,953 | 4/1926 | Jackson . | |
| 2,296,960 | 9/1942 | Tate | 206/486 |
| 2,857,045 | 10/1958 | Foote et al. | 206/491 |
| 3,453,758 | 7/1969 | Soref et al. | 40/21 |
| 3,858,419 | 1/1975 | Hampton | 70/55 |
| 3,952,560 | 4/1976 | Lee | 70/52 |
| 4,043,159 | 8/1977 | Malacheski et al. | 70/53 |
| 4,134,280 | 1/1979 | Pelavin | 70/55 |
| 4,247,003 | 1/1981 | Jones | 206/486 |
| 4,286,445 | 9/1981 | Sills | 70/55 |
| 4,462,538 | 7/1984 | Gendron | 40/310 |
| 4,799,370 | 1/1989 | Cooper | 70/63 |
| 4,897,945 | 2/1990 | Webb | 40/331 |
| 5,003,795 | 4/1991 | Hoke | 70/455 |
| 5,046,339 | 9/1991 | Krell | 70/55 |

OTHER PUBLICATIONS

CLC Industries; Lock 130X Detent Clip; 1991.

Superior Real Estate Supply (A Division of Farnom Company); Lock Box Nut; 1992.

Superior Real Estate Supply (A Division of Farnum Company); "Sellers Doorhangers"; 1991.

*Primary Examiner*—Renee S. Luebke

*Assistant Examiner*—D. Boucher

[57] ABSTRACT

A shield for a lock or lock box that protects surfaces that said locks or lock boxes contact from being scratched or damaged. The shield, which is generally a rectangular shape, is cut out of a flat sheet of flexible and resilient material. A single horizontal slot is or two horizontal slots are provided near the top end of the shield for weaving onto the shackle of a lock or lock box. The middle portion of the shield extends down the back of said lock or lock box. A generally u-shaped cut near the bottom end of the shield produces a loop that may be pulled up and around the lock or lock box body to create a protective bumper which surrounds the front and sides of said lock or lock box. Other embodiments of the shield are disclosed.

20 Claims, 5 Drawing Sheets

SHIELD FOR A LOCK OR LOCK BOX

BACKGROUND-FIELD OF INVENTION

This invention pertains to coverings and shields for padlocks and lock boxes, more particularly to shields that attach to padlocks or lock boxes to protect surfaces from being scratched or damaged by said padlocks or lock boxes.

BACKGROUND-DESCRIPTION OF PRIOR ART

Padlocks and lock boxes having u-shaped shackles often damage the surfaces that they contact, especially if they are attached to a moving surface such as a door that is frequently opened and closed or a moving vehicle. The padlocks and lock boxes generally swing by their shackle and create semicircular scratches. Or they can hit the surface sharply, creating a dent.

U.S. Pat. No. 3,453,758 shows a bumper for a padlock. The bumper consists of a band that surrounds the padlock body either at its bottom or top. Advantages are that the band provides some cushioning to the lock and is relatively simple to construct. A further advantage is that the band can be printed with indicia. Once attached, the bumper is not designed to be removed. This may be a disadvantage, because the bumper may become damaged before the padlock has lost its usefulness; a removable or replaceable bumper would extend the usefulness of the combined padlock and bumper. Another disadvantage is that the band relies on tightly encircling the body of the lock to remain attached. A friction fit between the band and the padlock may not be durable; given the differences in the effect heat and moisture have on a flexible material such as rubber or plastic as compared to metal, the bond between them may be stressed to the extent that the bumper may fall off while the padlock is in use. A further disadvantage of the band is that it covers only a small portion of the lock. Although this may provide sufficient protection when the lock is laying flat against a surface, if the lock were at an angle to any surface, an exposed corner or edge of the lock may scratch the surface.

U.S. Pat. No. 3,952,560 also shows a padlock having a bumper. The advantage is that the bumper contains notches to receive projections on the padlock so that it will be held more securely onto the padlock. A disadvantage is that the bumper is contoured to fit a specific padlock having projections. And it is only useful when combined with a padlock as shown. Otherwise this bumper shares the advantages and disadvantages of the bumper described in U.S. Pat. No. 3,453,758 discussed previously.

U.S. Pat. No. 4,134,280 shows a cover for a padlock that extends over the entire body of the lock. The advantage is that surfaces contacted by the body of the lock are protected even if the padlock is positioned at an angle to the surfaces. Another advantage is that the cover is releasably securable to the padlock so that it can be easily placed on and removed from the lock body. However this cover like the bumper of U.S. Pat. No. 3,952,560, is designed to be mated with a specific padlock having three ribs as shown. It would only be useful in combination with the described padlock.

U.S. Pat. No. 3,858,419 shows a two-part protective cover for a padlock consisting of an open ended sleeve and a lid and base linked by a flexible connector. An advantage of this protective cover is that it could attach to any padlock. However, Because there are two holes at the base of the u-shaped shackle, said holes must be spaced to match the spacing of the ends of the shackle to fit the padlock. Also the cover which has six sides to completely surround the padlock, must be sized to fit the padlock body. Because the construction is relatively complex (a mold would need to be created for each lock size), it would be uneconomical to have sizes to accommodate a wide variety of locks. Another disadvantage is that this cover may not completely seal the lock from moisture and may instead act to trap condensation or moisture. Another disadvantage is that the entire cover must be maneuvered to thread the shackle through the two holes. Another disadvantage is that it is relatively difficult to access the key hole to open the padlock; the case must be opened to access the key hole.

U.S. Pat. No. 4,286,445 shows a protective cover for a padlock constructed of flexible sheet material. Although the primary objective of this cover is to protect the padlock from moisture or dust, the cover could also serve to protect surfaces from being damaged by the padlock. This cover shares the advantages of the above mentioned cover yet is constructed as one unit. Thus there are no pieces that could fall off or become lost. However such covers are also complex to construct, (it has a hinged top and bottom and requires assembly). And such covers share the other disadvantages of the above mentioned cover.

U.S. Pat. No. 1,581,953 shows a protecting cover for padlocks. Said cover is constructed of leather or other suitable material. Such covers are designed to protect the padlock body and other surfaces from being scratched by the padlock. Also such covers are intended to prevent unnecessary noise caused by the lock striking another surface. Such covers have tongues on the back of the cover that pass on either side and between the ends of the u-shaped shackle. An advantage of such covers having such tongues is that the open end of the shackle need not be threaded through two holes. Also the construction is relatively simple. And the cover has an appearance that is more elegant than the above mentioned covers. A disadvantage is that the cover must be removed to operate the lock. Also a snap fastener requires precise alignment between the snap pin and the snap receptacle to fasten.

Real estate lock boxes often scratch and damage the surfaces that they contact. Because they are generally much heavier than a standard padlock, they can cause more damage. This can be particularly distressing to the agent responsible for hanging the lock box. The lock boxes are most often hung on the doorknob of a house for sale. Opening and closing the door causes the lock box to swing and create semicircular scratches. A potential buyer can almost judge how long a house has been on the market by the tell-tale "rings" left by the lock box on the front door. Also a lock box can even swing into the doorjamb and be wedged between the door and the doorjamb. This can cause deep scarring in the wood and can damage the soft insulation around the door frame.

Although most lock boxes include a bumper similar to the padlock bumpers shown in the patents discussed previously, the bumper does not sufficiently protect the doors. The exposed corners and edges of the lock box still can scratch the door. Also the weight of the lock box creates sufficient pressure to cause the bumper to rub and mark the door. An additional cover or shield is required to adequately protect the door from these lock boxes.

The front, side, back and bottom of many lock boxes must be accessible so that a code can be entered in the front, the house key that is stored inside can be released from the bottom, the lock box key can be inserted into the side, and a button on the back can be pressed. Therefore a padlock cover of the previously discussed patents which cover all sides of the body of the lock would not be useful for most lock boxes unless openings were created that allow access to the parts of the lock box described. If such covers were modified in this way they would be: further complicated, less economical and less attractive. Thus some inventions have emerged to address the specific problem of lock box damage to doors:

U.S. Pat. No. Des. 307,769 shows a lock box door protective shield having a business card holder. The shield hangs on a doorknob between the door and the lock box. The advantage is the simplicity of the shield; it is essentially flat and it does not have to be molded to fit a particular lock box. Therefore it is independent of the lock box. However, because it can move independently, it can move out from behind the lock box leaving the door unprotected. Also such shields offer no protection for the front and sides of the lock box. And they do not protect the doorjamb and the insulation on the door when the lock box is caught between the door and its frame. Another disadvantage is that such shields are constructed of two layers of material stitched together with a third layer creating the pocket at the bottom. And the bond between the layers of material used in such shields may be weaker than the material itself, especially if the material is plastic and the bond is stitching. The layers may become separated from each other so that the shield is unattractive or the pocket is no longer in tact. Also, although it may appear to be an advantage to provide a pocket to hold business cards, there are some disadvantages to such pockets: for the business cards to be visible, a clear plastic must be used and the bond between plastics may not be sufficiently durable to withstand cards being pulled out of the pocket repeatedly over time. The business card pocket is located under the lock box, and this may make accessing the cards difficult. The pocket will trap moisture causing the cards to become damp and possibly soiled. Further if an agent chooses not to leave a card, the shield may look incomplete and less attractive.

U.S. Pat. No. 4,897,945 also shows a protective shield having a business card holder. An advantage is that these shields are made of two layers of material and the pocket is created by a slot cut across the shield through one layer. The pocket opens in the back of the shield. And the card is visible through the front clear layer of plastic. An advantage of such shields is that they offer greater protection for the cards than a pocket that opens in the front of the shield. However moisture may still become trapped inside the pocket and damage the cards. Also accessing the cards is made even more difficult by the backside opening. Otherwise such shields share the advantages and disadvantages of the shields shown in Pat. No. Des. 307,769.

Other shields are available that do not have a business card pocket. Such shields are very economically constructed of a single layer of material and are printed with a variety of indicia and wordage. A disadvantage to such shields is that like the other lock box shields, they offer minimal protection.

Another available product which attempts to solve the problem of lock boxes damaging doors is the lock box detent clip. The detent clip attaches to the side of the door and presses against one side of the lock box. There are some disadvantages to such clips. The clip relies on a friction fit to secure it to the edge of the door. And installing such a clip may scratch the door. Also the lock box still contacts the door and is capable of swinging and scratching the door.

Also available is the "Lock box nut." The lock box nut is a flat piece of soft plastic which slips over the shackle of the lock box and rests flatly against the top of the body of the lock box. The edge of the lock box nut extends past the edge of the body of the lock box to hold the lock box off of the surface of the door. An advantage of this product is that it attaches to the lock box so that it moves with the lock box. Also it is simply and economically constructed. A disadvantage is that the pressure of the weight of the lock box is concentrated into a single edge against the door. This may cause damage at the point of contact. Also, if the lock box nut shifts to rest at an angle to the top of the body of the lock box, it may no longer extend past the edge of the lock box so that the lock box contacts the door. Further, the bottom edges of the lock box may still cause damage to the door edge and the doorjamb.

A shield or covering for a lock or a lock box should protect the surface that it contacts from every edge of said lock or lock box. Preferably such a shield can be printed with indicia, its form complements the form of the lock or lock box, it is durable, it is removable and it is inexpensive to manufacture.

SUMMARY OF THE INVENTION

A shield of the present invention is preferably constructed of flexible material and is preferably generally rectangular in shape. The sides of the rectangle are generally proportioned to extend past the sides of the body of a lock or lock box. Near the top end of the shield are two parallel horizontal slots. The slots are as long or longer than the width of the base of the shackle of a lock or lock box. And they are as wide or wider than the diameter of the bar that forms the shackle. Near the bottom end of the shield is a cut that is generally u-shaped and approximately matches the front and sides of a horizontal cross section of the middle to lower portion of a lock or lock box.

A shield of the present invention attaches to a lock or lock box in the following manner: the lock or lock box shackle is woven through one or both of the parallel slots near the top of the shield. When the shackle is woven through both of the parallel slots, the section of the shield between the slots is oriented so that it faces forward. The middle portion of the shield extends down the back of the lock or lock box. And a loop created by the generally u-shaped cut near the bottom of the shield is pulled up around the lower portion of the lock or lock box to create a bumper that surrounds the front and sides of the lock box.

When attached to a lock box, the flat shield becomes a three-dimensional protective jacket that compliments the form of the lock or lock box. Surfaces that come in contact with the lock or lock box are protected from the edges of the lock or lock box by the present invention. Also the shield provides many interesting spaces for printing a logo or other indicia such as the space between the parallel slots that is held flat across the front of the shackle, the bumper-loop that encircles the front and sides of the body of the lock or lock box and the portion of the shield formed by the inside of the u-shaped cut that may extend below the body of the lock or lock box.

Because the shield fits relatively tightly, objects such as business cards or notes can be securely inserted behind the lock or lock box. The elbow created by the bumper flap becomes a surface that can support objects. And the tight fit creates the pressure needed to hold even a single business card in place if desired. Cards held in this manner are easier to retrieve than cards held inside a pocket. They are held securely without being completely enclosed on three sides. Also because they are not enclosed, moisture is not as apt to be trapped next to the cards.

An additional product may be used to draw attention to cards or notes stored between the shield and the lock box such as a tab that extends past the side of the shield containing printing or an "eye-catching" color.

The preferred embodiment of the present invention is constructed of a clear flexible vinyl sheet. An advantage of clear vinyl is that the color of the surface behind the lock or lock box can be seen through the shield. And the shield is unobtrusive and complimentary to the lock or lock box and the surface behind. Another advantage of such a material is an ability to removably adhere to a smooth surface. For the shield this may be advantageous because it may retard the swinging motion of the lock or lock box against the surface. A more surprising advantage of this adherability is that it affords a usefulness to the cut-outs produced when the horizontal slots in the shield are created. The cut-outs become stickers that can be used to post notes to glass or other smooth surfaces. And they can contain printing for use as promotional stickers which are easily removed and reattached. Also they are useful as a toy or game; they stick to each other for creating "works of art." And pictures or messages can be created using a number of these cut-outs on a car window or any window. They can possibly be dyed translucent colors to enhance their usefulness as a creative toy; different colored cut-outs can be stuck together to "mix colors," teaching some basic principles of color theory. Also stickers can be linked together via pins grommets or other fasteners to create a moveable chain of stickers or "snake" that can removably adhere to smooth surfaces; the ends of the stickers can overlap and be pivotally fastened together to form such a "snake."

A unique feature of these stickers is that they are of a thickness, length and width such that they cannot fold and stick to themselves. And they are grippable and easily removed from any surface they adhere to.

Although this "bonus" product is unrelated to the present invention in function, as a by-product it may be considered a component of the present invention. With the present environmental concerns, the discovery of a use for a by-product may be of great benefit as it reduces the waste normally generated by the manufacturing process. And such discoveries would be encouraged by the allowance of protection under any patent granted for the parent invention.

As stated previously, a shield of the present invention may also be attached to a lock or lock box by weaving only the top horizontal slot onto the shackle. The second slot would then slip behind the body of the lock. Although this would eliminate the visibility of the space between the two slots which is a prime location for a printed logo or other indicia, weaving the shackle through only the top horizontal slot may be preferable for a lock or lock box having a short shackle.

Another embodiment of a shield of the present invention has only one horizontal slot for such situations when a second slot is not advantageous.

An additional embodiment of a shield of the present invention would have horizontal slots as described above but would not include the u-shaped cut which creates the bumper-loop that surrounds the front and sides of the lock or lock box. Such an embodiment would be a shield that extends down the back of a lock or lock box, having two horizontal slots near its top for weaving onto the shackle of said lock or lock box. Such an embodiment would be especially useful for a small padlock or a round combination lock.

Still another embodiment without the u-shaped cut would have one horizontal slot. Such an embodiment would be especially useful for small padlocks and round combination locks having short shackles.

A further embodiment may have multiple slots to allow for adjustability of a shield of the present invention. A slot or two slots can be woven onto the shackle of a lock and any excess that extends above the slots that best fit a particular lock may be trimmed off.

It is an object of the present invention to provide a shield for a lock or a lock box that protects surfaces from being scratched or damaged by said locks or lock boxes.

It is a further object of the present invention to provide a shield that attaches to the shackle of a lock or lock box so that it remains with said lock or lock box.

It is a further object of the present invention to provide a shield that can surround the front and sides of a lock or lock box to give additional protection to surfaces from said lock or lock box.

It is a further object of the present invention to provide a shield having locations for printing a logo or other indicia.

It is a further object of the present invention to provide a shield that is easily and inexpensive manufactured.

It is a further object of the present invention to provide a shield that may be formed of a single layer of material.

It is a further object of the present invention to provide a shield that is flat until in use so that it is easily stored and shipped.

It is still another object of the present invention to compliment the form of the lock or lock box.

It is still another object of the present invention to create a useful by-product in the die-cutting of the present invention.

Other objects, features and advantages of the present invention will become apparent with reference to the remainder of this document.

BRIEF DESCRIPTION OF THE DRAWINGS

The invention is now illustrated in detail by means of the drawings in which.

DESCRIPTION OF THE PREFERRED EMBODIMENT

Figure 1:
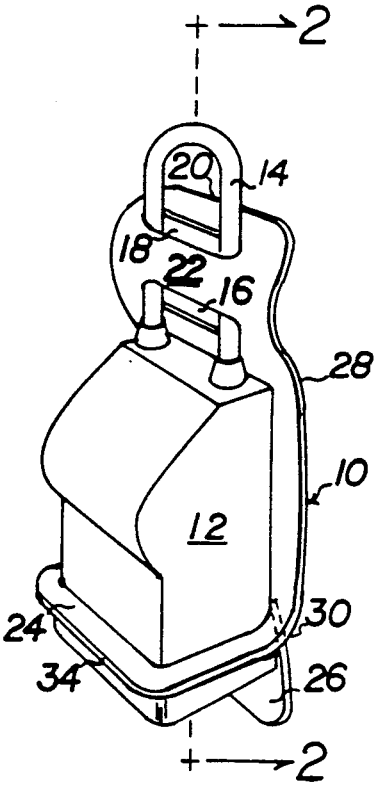
FIG. 1 is a perspective view of the first embodiment of a shield according to the present invention shown attached to a lock box, said lock box having a long shackle.

Referring to the figures, FIG. 1 shows a shield 10 that is attached to a lock box 12 having a relatively long shackle 14. The shackle 14 is woven through a bottom horizontal slot 16 and top horizontal slot 18. Said slots are located near the top end 20 of the shield 10. The section 22 between the bottom slot 16 and the top slot 18 lays on the front side of the shackle 14 of the lock box 12. A bumper-loop 24 surrounds the front and sides of the lock box 12. A flap 26 extends past the bottom of the lock box 12.

Figure 2:
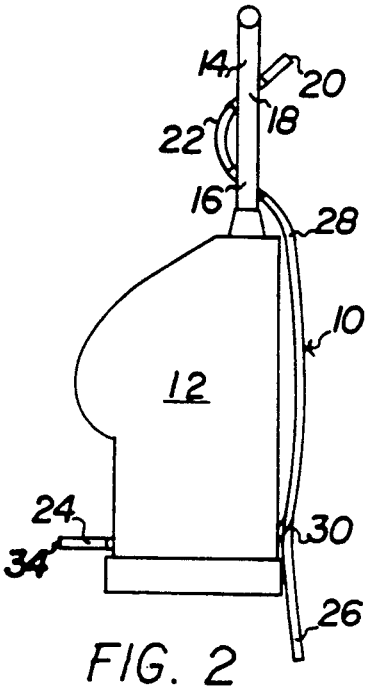
FIG. 2 is a sectional view of the shield of FIG. 1, taken along lines 2—2 of FIG. 1.

FIG. 2 shows a sectional view of the shield 10 attached to the lock box 12. A bend 28 orients the top portion of the shield 10 so that it may attach to the shackle 14. The section 22 curves outwardly so that the bottom slot 16 and the top slot 18 may be laced onto the shackle 14 of the lock box 12. A second bend 30 near the bottom of the shield 10 allows the bumper-loop 24 to fit around the lock box 12. The bumper-loop 24 is shown to be generally perpendicular to the flap 26 that extends past the bottom of the lock box 12.

Figure 3:
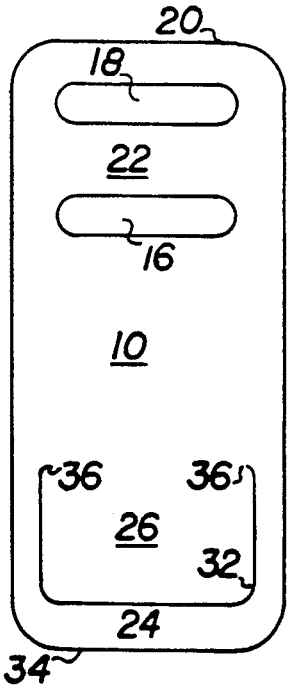
FIG. 3 is a front elevational view of the shield of FIG. 1.

FIG. 3 shows a front elevational view of the shield 10. A u-shaped cut 32, located near the bottom end 34 of the shield 10, produces the bumper-loop 24 and the flap 26. The ends 36 of the u-shaped cut 32 curve inwardly towards the center of the shield 10 to prevent tearing.

Figure 4:
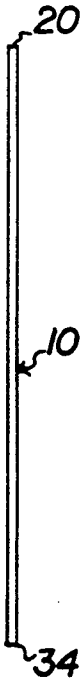
FIG. 4 is a side elevational view of the shield of FIG. 1.

FIG. 4 shows a side elevational view of the shield 10. The shield 10 is shown to be formed of a flat piece of material.

Figure 5:
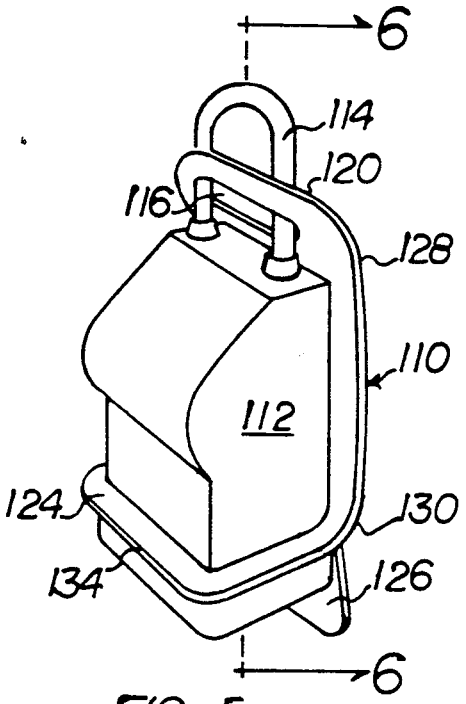
FIG. 5 is a perspective view of the second embodiment of a shield according to the present invention shown attached to a lock box, said lock box having a relatively short shackle.

FIG. 5 shows a shield 110 that is attached to a lock box 112 having a relatively short shackle 114. The shackle 114 is woven through a single horizontal slot 116. Said slot is located near the top end 120 of the shield 110. The edge of the top end 120 of the shield 110 is shown to be facing generally forward on the front side of the shackle 114 of the lock box 112. A bumper-loop 124 surrounds the front and sides of the lock box 112. A flap 126 extends past the bottom of the lock box 112.

Figure 6:
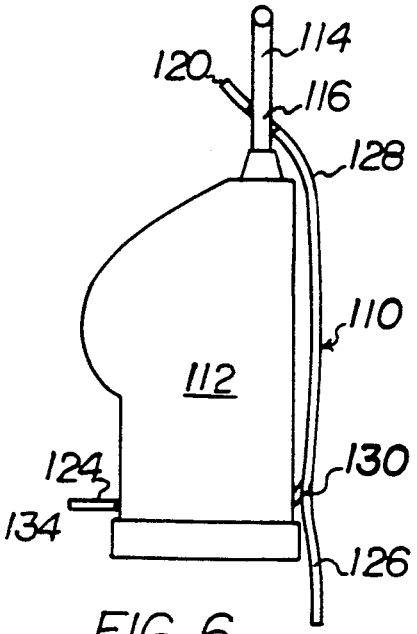
FIG. 6 is a sectional view of the shield of FIG. 5 taken along lines 6—6 of FIG. 5.

FIG. 6 shows a sectional view of the shield 110 attached to the lock box 112. A bend 128 orients the top portion of the shield 110 so that it may attach to the shackle 114. A second bend 130 near the bottom end 134 of the shield 110 allows the bumper-loop 124 to fit around the lock box 112. And the bumper-loop 124 is shown to be generally perpendicular to the flap 126 that extends past the bottom of the lock box 112.

Figure 7:
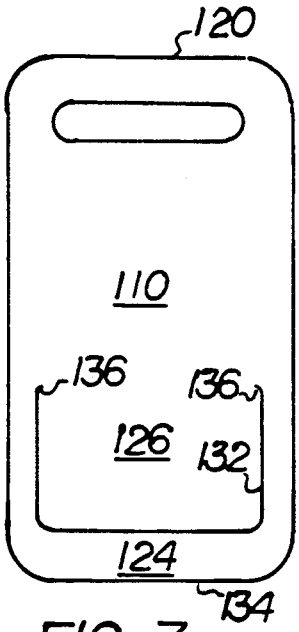
FIG. 7 is a front elevational view of the shield of FIG. 5.

FIG. 7 shows a front elevational view of the shield 110. A u-shaped cut 132, located near the bottom end 134 of the shield 110, produces the bumper-loop 124 and the flap 126. The ends 136 of the u-shaped cut 132 curve inwardly towards the center of the shield 110 to prevent tearing.

Figure 8:
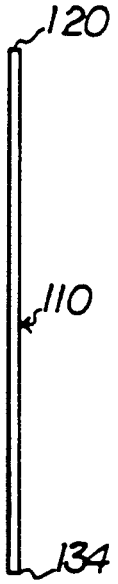
FIG. 8 is a side elevational view of the shield of FIG. 5.

FIG. 8 shows a side elevational view of the shield 110. The shield 110 is shown to be formed of a flat piece of material.

Figure 9:
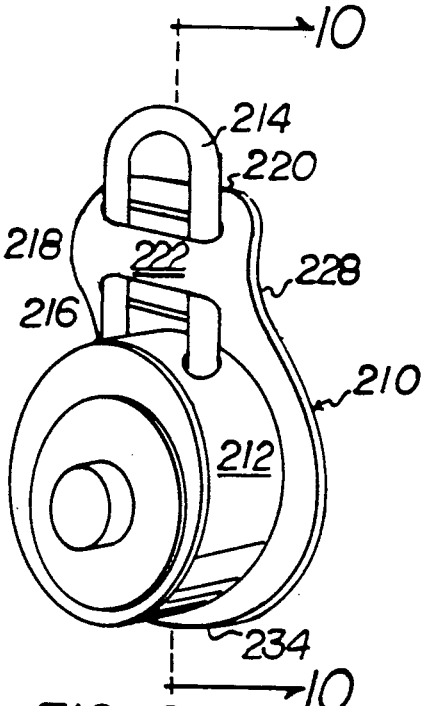
FIG. 9 is a perspective view of the third embodiment of a shield according to the present invention shown attached to a lock, said lock having a long shackle.

FIG. 9 shows a shield 210 that is attached to a lock 212 having a relatively long shackle 214. The shackle 214 is woven through a bottom horizontal slot 216 and top horizontal slot 218. Said slots are located near the top end 220 of the shield 210. The section 222 between the bottom slot 216 and the top slot 218 lays on the front side of the shackle 214 of the lock 212. The bottom end 234 of the shield 210 extends past the bottom of the lock 212.

Figure 10:
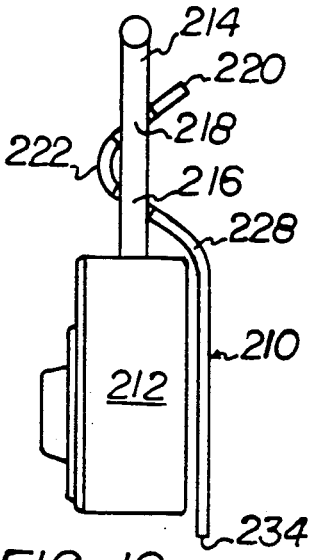
FIG. 10 is a sectional view of the shield of FIG. 9, taken along lines 10—10 of FIG. 9.

FIG. 10 shows a sectional view of the shield 210 attached to the lock 212. A bend 228 orients the top portion of the shield 210 so that it may attach to the shackle 214. The section 222 curves outwardly so that the bottom slot 216 and the top slot 218 may be laced onto the shackle 214 of the lock box 212.

Figure 11:
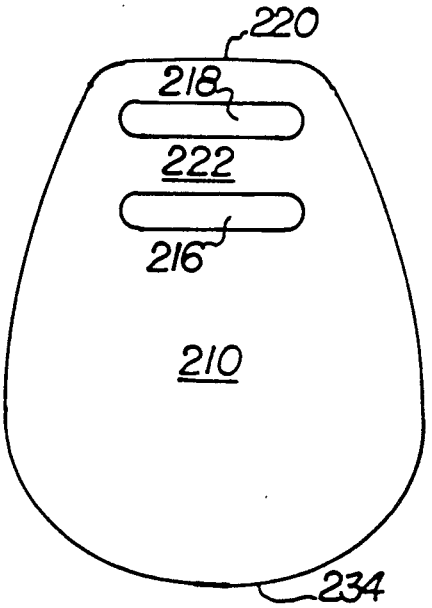
FIG. 11 is a front elevational view of the shield of FIG. 9.

FIG. 11 shows a front elevational view of the shield 210. The shield 210 is shown to be generally pear-shaped to compliment the shape of the round lock 212.

Figure 12:
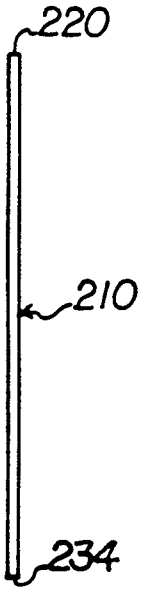
FIG. 12 is a side elevational view of the shield of FIG. 9.

FIG. 12 shows a side elevational view of the shield 210. The shield 210 is shown to be formed of a flat piece of material.

Figure 13:
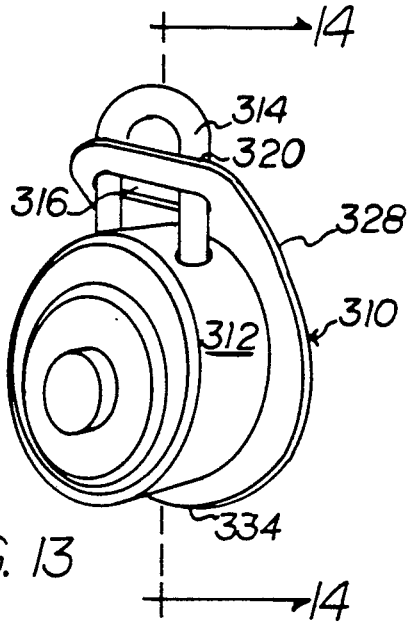
FIG. 13 is a perspective view of the fourth embodiment of a shield of the present invention shown attached to a lock, said lock having a relatively short shackle.

FIG. 13 shows a shield 310 that is attached to a lock 312 having a relatively short shackle 314. The shackle 314 is woven through a single horizontal slot 316 which is located near the top end 320 of the shield 310. The edge of the top end 320 of the shield 310 is shown to be facing generally forward on the front side of the shackle 314 of the lock 312.

Figure 14:
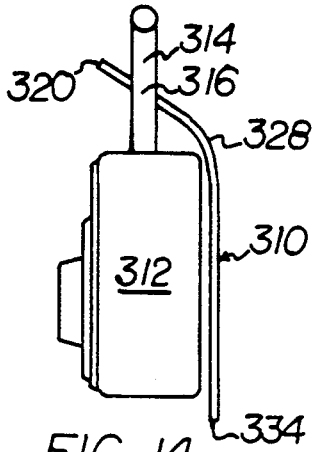
FIG. 14 is a sectional view of the shield of FIG. 13, taken along lines 14—14 of FIG. 13.

FIG. 14 shows a sectional view of the shield 310 attached to the lock 312. A bend 328 orients the top portion of the shield 310 so that it may attach to the shackle 314. The bottom end 334 of the shield 310 extends past the bottom of the lock 312.

Figure 15:
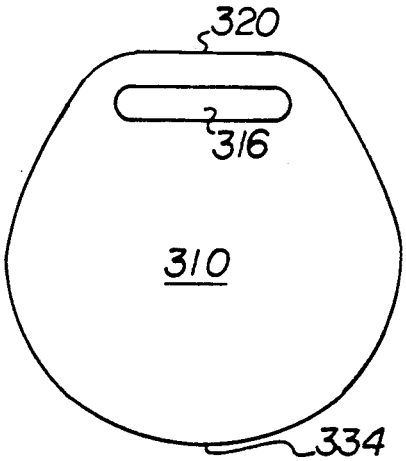
FIG. 15 is a front elevational view of the shield of FIG. 13.

FIG. 15 shows a front elevational view of the shield 110. The shield 310 is shown to be generally pear-shaped to compliment the shape of the round lock 312.

Figure 16:
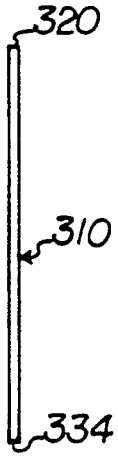
FIG. 16 is a side elevational view of the shield of FIG. 13.

FIG. 16 shows a side elevational view of the shield 310. The shield 310 is shown to be formed of a flat piece of material.

Figure 17:
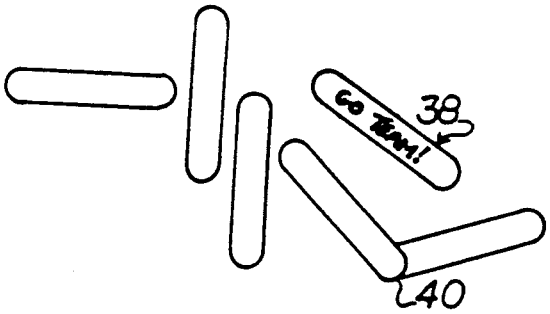
FIG. 17 is a front elevational view of stickers according to the present invention which are a by-product of the shield of the present invention.

FIG. 17 shows a front elevational view of stickers that are a by-product of the shields 10, 110, 210 and 310, when said shields are cut from a flat piece of material. The stickers 38 are the punch-outs produced when the horizontal slots 16, 18, 116, 216, 218, or 316 are cut. The stickers may contain printing as shown at 38. The stickers can stick to each other as shown at 40.

Figure 18:
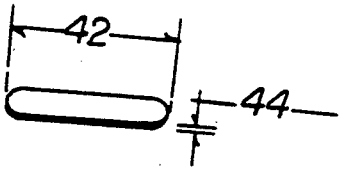
FIG. 18 is a perspective view of a single sticker such as shown in FIG. 17.

FIG. 18 shows a perspective view of a single sticker. The length 42 and thickness 44 of each sticker are such that the sticker is incapable of folding and adhering to itself.

Figure 19:
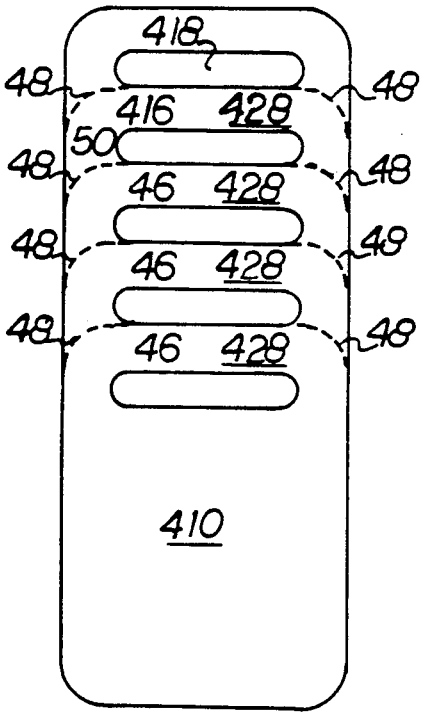
FIG. 19 is a front elevational view of the fifth embodiment of a shield of the present invention.

FIG. 19 shows a front elevational view of a shield 410. Shield 410 has a top horizontal slot 418 a second horizontal slot 416 and additional horizontal slots 46. Perforations 48 across the shield 410 allow portions of the shield 410 to be removed so that said shield can be adapted by the end user to fit a range of locks or lock boxes.

Figure 20:
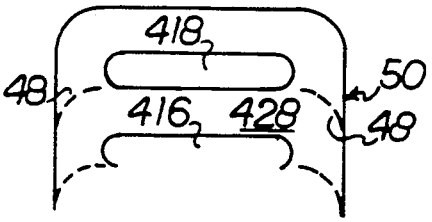
FIG. 20 is a front elevational view of a portion that has been removed from the shield of FIG. 19.

FIG. 20 shows a front elevational view of a portion 50 of the shield 410 that has been removed from said shield.

Figure 21:
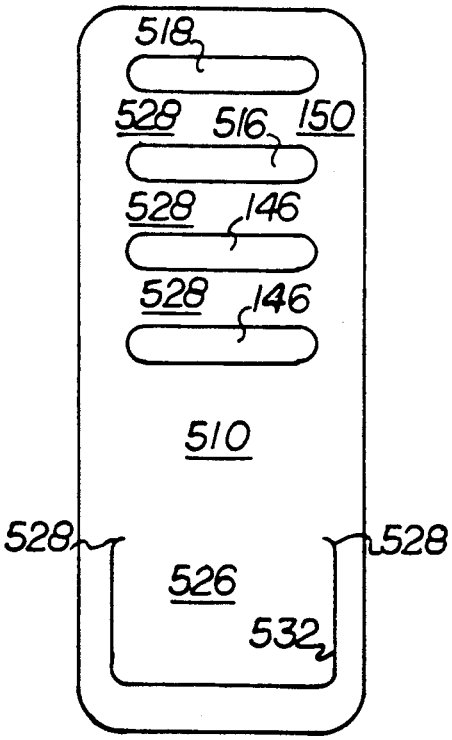
FIG. 21 is a front elevational view of the sixth embodiment of a shield of the present invention.

FIG. 21 shows a front elevational view of a shield 510. Shield 510 has a top horizontal slot 518 a second horizontal slot 516 and additional horizontal slots 146. Portions of the shield 510 may be cut off so that said shield can be adapted by the end user to fit a range of locks or lock boxes.

Figure 22:
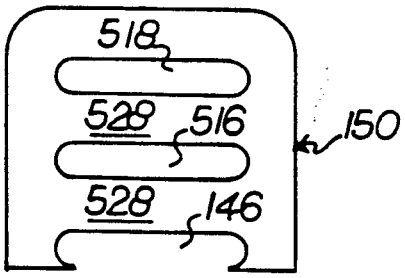
FIG. 22 is a front elevational view of a portion that has been removed from the shield of FIG. 21.

FIG. 22 shows a front elevational view of a portion 150 of the shield 510 that has been removed from the said shield.

In the first, second, third, fourth, fifth and sixth embodiments of the present invention, the shield 10, 110, 210, 310, 410 and 510 are preferably constructed of heavy-gage, flexible, clear vinyl. However said shields could be constructed of any flexible material such as clear or opaque light or heavy gage plastic of any kind. Other flexible materials said shields could be formed of include leather, rubber, cloth, felt, woven material of any kind, paper, thin cardboard or wire mesh. Said shields could also be constructed of a combination of rigid and flexible material wherein the flexible material is located at the bends 28, 128, 228, and 328 of the shields 10, 110, 210 and 310, and also at the bends 30 and 130 of the shields 10 and 110 as well as the bendable portions 428, 528 and 530 of shields 410 and 510. A flexible portion should also be included at the sections 22 and 222 of the shields 10 and 210. Some materials that could be combined with the flexible materials listed above include rigid plastic, wood and cardboard. Further the shield 310 having a single bend 328 located at the top of the body of the lock 312 could be made of rigid or mostly rigid material. And the bend 328 could be pre-formed in the material.

The shields 10, 110, 210, 310, 410 and 510 are preferably die-cut from a flat sheet of material. However, they could be formed in a mold through an injection molding process or other molding process. Said shields are formed of a material having an even thickness. However if a rigid material is used, the material at the bends 28, 128, 228, and 328 in the shields 10, 110, 210 and 310, the bends 30 and 130 in the shields 10 and 110, the bendable portions 428, 528 and 530 of the shields 410 and 510 and the curves in the sections 22 and 222 of the shields 10 and 210 could be thinned to create flexible portions or "Living hinges." Thus even if a substantially rigid material were used, said shields would be sufficiently flexible to attach to the locks 212 and 312 or the lock boxes 12 and 112 (or a wide range of locks and lock boxes as for the shields 410 and 510) and to be stored flat when not in use.

The sections 22 and 222 in the shields 10 and 210 are preferably a solid strong material. However they could contain perforations between the bottom slots 16 and 216 and the top slots 18 and 218 so that the top portions of the shields 10 and 210 could be removed by the user to produce shields that closely resemble the shields 110 and 310 having single slots 116 and 316. Thus they would adapt to fit lock boxes 112 and locks 312 having short shackles 114 and 314.

A single slot 116 or 316 or two slots 16 and 18 or 216 and 218 are used to attach the shields 10, 110, 210 and 310 to the lock boxes 12 and 112 or locks 212 and 312. However multiple slots could be formed in said shields as in the shields 410 and 510, so that a wide range of locks or lock boxes could be accommodated by said shields. And perforations could be added so that portions of said shields that are not necessary could be removed by the end user.

The horizontal slots 16, 18, 116, 216, 218, 316, 416, 418, 46, 516, 518 and 146 are preferably only slightly longer than the width of the shackles 14, 114, 214 and 314 of the lock boxes 12 and 112 and the locks 212 and 312 (as well as the range of locks and lock boxes that may be used with the shields 410 and 510). However they could be longer than the width of said shackles. Also said slots are preferably only slightly wider than the thickness of said shackles. But they could be any width provided they are adapted to being laced onto said shackles.

The shields 210 and 310 are shown to be generally pear-shaped to complement the forms of the locks 212 and 312. However they could be rectangular or square in shape. And they could be cut to any shape that is considered complimentary in design provided they contain slots for lacing onto the shackles 214 and 314 and they extend down the backs of the locks 212 and 312. The bottom ends 234 and 334 of said shields are shown to extend past the bottoms of the locks 212 and 312. However they could bend as at 228 and 328 and extend only partially down the backs of said locks to provide sufficient padding between the backs of said locks and the surfaces they may contact.

The sections 22 and 222 of shields 10 and 210 as well as the bendable portions 428 and 528 of shields 410 and 510 may contain printing so that said shields could be used as promotional items. Or a business card could be folded and tucked behind said sections or said portions.

The flaps 26, 126 and 526 in the shields 10, 110 and 510 extend well below the bottoms of the lock boxes 12 and 112 and may also extend well below locks and lock boxes which use the shield 510 having additional slots 146. Thus these flaps may also contain printing. However they could be shortened so that they extend only slightly below said lock boxes. Or they could be removed; the u-shaped cuts 32, 132 and 532 could be replaced by full rectangular cuts so that the portion of the shields 10, 110 and 510 that formed the flaps 26, 126 and 526 are no longer part of the shields 10, 110 and 510.

The locks 212 and 312 are shown to be generally round in shape. However they could be any shape, and as stated, the shields 210 and 310 could also be any shape that compliments or accommodates the form of said locks provided they attach to said locks as shown. Further the shields 210 and 310 which have no bumper-loops 24 and 124, may be used on lock boxes 12 and 112, although it may be preferable for said lock boxes to have the additional padding afforded by said bumper-loops.

Likewise the lock boxes 12 and 112 which are shown to be of a distinct shape (having a heavy rounded top portion and a straight bottom portion), could be a wide range of forms. And the shields 10, 110, 210 and 310 could be modified to accommodate the variables of said lock boxes. Further the u-shaped cuts 32, 132 and 532, which preferably have flat sides and bottoms, could be generally semicircular to create bumper-loops that accommodate a lock or lock box having a semicircular horizontal cross section. Or said u-shaped cuts could be any form that produces bumper-loops that fit the horizontal cross section of any locks or lock boxes having shackles.

The stickers which are the punch-outs of the horizontal slots 16, 18, 116, 216, 218, 316, 416, 418, 46, 516, 518 and 146 created when the shields 10, 110, 210, 310, 410 and 510 are cut from a flat sheet of material are preferably clear vinyl. However they could be died translucent or opaque colors. Or they could be any material that said shields are cut from provided they are adherably removable from a smooth surface, and provided the length and thickness of each sticker is such that it cannot fold and adhere to itself.

The stickers are loose and nonconnected. But they could be connected by pins or other types of fasteners to form a movable chain or "snake" that can stick to smooth surfaces.

I claim:

1. A lock box shield for a lock or lock box having a U-shaped shackle, front, back and sides, said shield having a top end and a bottom end with two horizontal slots located near the top end; both of said slots for lacing onto both legs of said shackle of the lock or lock box, wherein the entire shackle extends through each of said slots; said shield for extending down the back of the lock or lock box.

2. A shield according to claim 1 formed of a sheet of flexible material.

3. A shield according to claim 1 further including a generally u-shaped cut having ends, said u-shaped cut being located near the bottom end of said shield to create a loop of material that is adapted to being pulled up to surround the front and sides of the body of the lock or lock box to form a bumper.

4. A shield according to claim 1 further including a generally u-shaped cut having ends, said u-shaped cut being located near the bottom end of said shield to create a loop of material that is adapted to being pulled up to surround the front and sides of the body of the lock or lock box to form a bumper; in which said ends of said generally u-shaped cut curve inwardly to prevent tearing.

5. A shield according to claim 1 further including a generally u-shaped cut having ends, said u-shaped cut being located near the bottom end of said shield to create a loop of material that is adapted to being pulled up to surround the front and sides of the body of the lock or lock box to form a bumper; said ends of said u-shaped cut curving inwardly to prevent tearing; wherein said shield is formed of a sheet of flexible material.

6. A shield according to claim 1 further comprising printing on specific areas of its surface.

7. A shield according to claim 1 further including a generally u-shaped cut having ends, said u-shaped cut being located near the bottom end of said shield to create a loop of material that is adapted to being pulled up to surround the front and sides of the body of a lock or lock box to form a bumper; said ends of said u-shaped cut curving inwardly to prevent tearing; in which said shield further comprises printing on specific areas of its surface.

8. A lock box shield for a lock or lock box having a U-shaped shackle, front, back and sides, said shield having a top end and a bottom end with a single horizontal slot located near the top end; said slot for lacing onto both legs of said shackle wherein the entire shackle extends through said slot; said shield when in use having no side walls and extending down the back of the lock or lock box.

9. A shield according to claim 8 formed of a sheet of flexible material.

10. A shield according to claim 8 further including a generally u-shaped cut having ends, said u-shaped cut being located near the bottom end of said shield to create a loop of material that is adapted to being pulled up to surround the front and sides of the body of the lock or lock box to form a bumper.

11. A shield according to claim 8 further including a generally u-shaped cut having ends, said u-shaped cut being located near the bottom end of said shield to create a loop of material that is adapted to being pulled up to surround the front and sides of the body of the lock or lock box to form a bumper; wherein said ends of said u-shaped cut curve inwardly to prevent tearing.

12. A shield according to claim 8 further including a generally u-shaped cut having ends, said u-shaped cut being located near the bottom end of said shield to create a loop of material that is adapted to being pulled up to surround the front and sides of the body of the lock or lock box to form a bumper; said ends of said u-shaped cut curving inwardly to prevent tearing; in which said shield is formed of a sheet of flexible material.

13. A shield according to claim 8 further comprising printing on specific areas of its surface.

14. A shield according to claim 8 further including a generally u-shaped cut having ends, said u-shaped cut being located near the bottom end of said shield to create a loop of material that is adapted to being pulled up to surround the front and sides of the body of the lock or lock box to form a bumper; said ends of said u-shaped cut curving inwardly to prevent tearing; wherein said shield further comprises printing on specific areas of its surface.

15. A lock box shield for a lock or lock box having a U-shaped shackle, front, back and sides, said shield having a top end and a bottom end with multiple horizontal slots located at the top end; each of said slots for lacing onto both legs of said shackle of the lock or lock box, wherein the entire shackle extends through any one of said horizontal slots; said additional slots provide a means of accommodating a range of sizes of locks and lock boxes; said shield for extending down the back of the lock or lock box.

16. A shield according to claim 15 further including a generally u-shaped cut having ends, said u-shaped cut being located near the bottom end of said shield to create a loop of material that is adapted to being pulled up to surround the front and sides of the body of the lock or lock box to form a bumper.

17. A shield according to claim 15 further including a generally u-shaped cut having ends, said u-shaped cut being located near the bottom end of said shield to create a loop of material that is adapted to being pulled up to surround the front and sides of the body of the lock or lock box to form a bumper; wherein said ends of said u-shaped cut curve inwardly to prevent tearing.

18. A shield according to claim 15 further including perforations between said slots, wherein said perforations provide a means of removing slots of said shield to allow for adjusting said shield to accommodate a specific size lock or lock box.

19. A shield according to claim 15 further including perforations between said slots and across said shield parallel to said slots, wherein said perforations provide a means of removing a slot or slots from said top portion to shorten said shield to allow for adjusting said shield to accommodate a specific size lock or lock box.

20. A shield according to claim 15 further including perforations between said slots and across said shield parallel to said slots, wherein said perforations provide a means of removing slots from said top portion to shorten said shield to allow for adjusting said shield to accommodate a specific size lock or lock box; said shield further including a generally u-shaped cut having ends, said u-shaped cut being located near the bottom end of said shield to create a loop of material that is adapted to being pulled up to surround the front and sides of the body of the lock or lock box to form a bumper.

* * * * *